US009774125B2

(12) United States Patent
Furuya et al.

(10) Patent No.: US 9,774,125 B2
(45) Date of Patent: Sep. 26, 2017

(54) CONNECTOR HAVING A MOVING PLATE

(71) Applicant: Tyco Electronics Japan G.K., Kanagawa (JP)

(72) Inventors: Sumiyoshi Furuya, Kanagawa (JP); Hiroki Kondo, Kanagawa (JP); Shinji Amemiya, Kanagawa (JP); Fumito Nagashima, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/331,153

(22) Filed: Oct. 21, 2016

(65) Prior Publication Data

US 2017/0117660 A1 Apr. 27, 2017

(30) Foreign Application Priority Data

Oct. 23, 2015 (JP) ..... 2015-208869

(51) Int. Cl.
*H01R 4/50* (2006.01)
*H01R 13/453* (2006.01)
*H01R 13/52* (2006.01)

(52) U.S. Cl.
CPC ..... *H01R 13/4538* (2013.01); *H01R 13/5219* (2013.01)

(58) Field of Classification Search
CPC .. H01R 13/6275; H01R 9/03; H01R 13/6272; H01R 13/465; H01R 13/641; H01R 13/4223; H01R 13/5219
USPC .... 439/350–358, 488, 489, 345, 595, 752.5, 439/271, 272
See application file for complete search history.

(56) References Cited

U.S. PATENT DOCUMENTS 4,902,247 A * 2/1990 Suzuki ..... H01R 13/5221 439/595
5,192,225 A * 3/1993 Suzuki ..... H01R 13/641 439/350

(Continued)

FOREIGN PATENT DOCUMENTS

JP 1992209479 A 7/1992
JP 1994077179 U 10/1994

(Continued)

OTHER PUBLICATIONS

Abstract of JP2000056919, dated Feb. 25, 2000, 2 pages.

*Primary Examiner* — Thanh Tam Le
(74) *Attorney, Agent, or Firm* — Barley Snyder

(57) ABSTRACT

A connector is disclosed. The connector has a housing, a terminal, and a moving plate. The housing has a mating connector receiving passageway and a raised portion formed inside the mating connector receiving passageway. The terminal is disposed in the housing and extends into the mating connector receiving passageway. The moving plate has a locking arm and an insertion hole into which the terminal is inserted. The moving plate is disposed in the mating connector receiving passageway and is movable between a front position in which a front end of the terminal is retracted inside the insertion hole and a rear position in which the terminal extends beyond the insertion hole. The raised portion abuts the locking arm and prevents deflection of the locking arm when the moving plate is located out of the front position.

16 Claims, 7 Drawing Sheets

(56) References Cited

U.S. PATENT DOCUMENTS

| | | | | | |
|---|---|---|---|---|---|
| 5,575,685 | A * | 11/1996 | Ittah | H01R 13/64 | 439/488 |
| 5,782,658 | A * | 7/1998 | Maegawa | H01R 13/5219 | 439/271 |
| 5,913,703 | A * | 6/1999 | Suzuki | H01R 13/518 | 439/489 |
| 5,928,038 | A * | 7/1999 | Berg | H01R 13/6272 | 439/489 |
| 5,931,700 | A * | 8/1999 | Saito | H01R 13/4365 | 439/489 |
| 5,934,946 | A * | 8/1999 | Nakamura | H01R 13/4362 | 439/489 |
| 6,123,574 | A * | 9/2000 | Matsuda | H01R 13/4223 | 439/488 |
| 6,416,344 | B2 * | 7/2002 | Okayasu | H01R 13/4365 | 439/352 |
| 6,468,105 | B2 | 10/2002 | Noguchi et al. | | |
| 6,682,367 | B2 * | 1/2004 | Suzuki | H01R 13/4362 | 439/595 |
| 7,559,787 | B2 * | 7/2009 | Shigeta | H01R 13/6272 | 439/358 |
| 9,070,995 | B2 | 6/2015 | Yagome et al. | | |
| 9,099,808 | B2 | 8/2015 | Kato et al. | | |

FOREIGN PATENT DOCUMENTS

| | | | |
|---|---|---|---|
| JP | 1995220811 | A | 8/1995 |
| JP | 1995282903 | A | 10/1995 |
| JP | 2000056919 | A | 2/2000 |

* cited by examiner

CONNECTOR HAVING A MOVING PLATE

CROSS-REFERENCE TO RELATED APPLICATION

This application claims the benefit of the filing date under 35 U.S.C. §119(a)-(d) of Japanese Patent Application No. 2015-208869, filed on Oct. 23, 2015.

FIELD OF THE INVENTION

The present invention relates to connector, and more particularly, to a connector for electric shock prevention.

BACKGROUND

Some hybrid vehicles or electric vehicles use high voltage that may, for example, reach as high as 1200V. Known connectors to which such a high voltage is applied have an electric shock prevention structure so as not to deliver an electric shock to a worker who handles the connector.

Japanese Patent Application No. 2014-530446, for example, discloses a connector that prevents a tool or a finger of the worker from coming into contact with a male terminal by means of a moving plate having an elastically deforming portion. Such an electric shock prevention structure must function with high reliability to ensure that the worker never gets an electric shock. In Japanese Patent Application No. 2014-530446, however, while the connector is mated with a mating connector, a locking hook of the moving plate remains deflected and is constantly stressed. When the connector is in a high temperature environment, the locking hook cannot return to an original locking state, and the moving plate no longer functions to prevent an electric shock.

SUMMARY

An object of the invention, among others, is to provide a connector having a highly reliable electric shock prevention structure. The disclosed connector has a housing, a terminal, and a moving plate. The housing has a mating connector receiving passageway and a raised portion formed inside the mating connector receiving passageway. The terminal is disposed in the housing and extends into the mating connector receiving passageway. The moving plate has a locking arm and an insertion hole into which the terminal is inserted. The moving plate is disposed in the mating connector receiving passageway and is movable between a front position in which a front end of the terminal is retracted inside the insertion hole and a rear position in which the terminal extends beyond the insertion hole. The raised portion abuts the locking arm and prevents deflection of the locking arm when the moving plate is located out of the front position.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
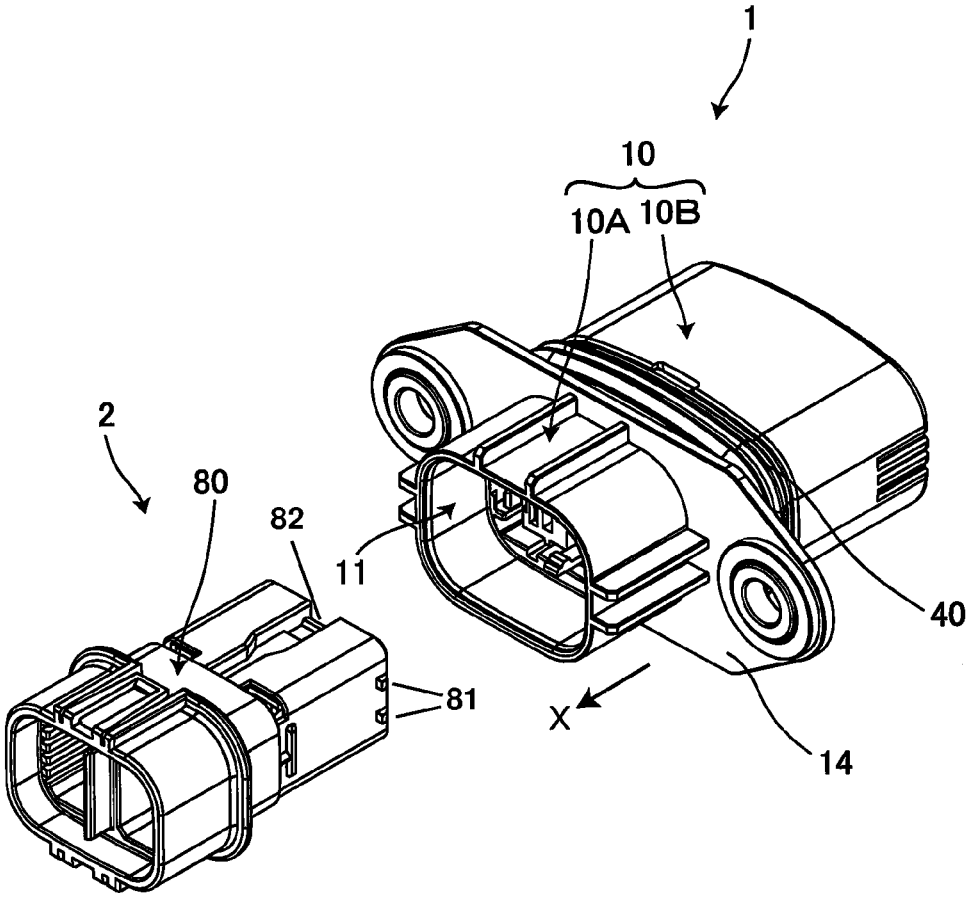
FIG. 1 is a perspective view of a connector and a mating connector according to the invention.

A connector 1 according to the invention is shown generally in FIG. 1 with a mating connector 2. The connector 1 has a housing 10, a plurality of terminals 20, a moving plate 30, and a seal ring 40. The major components of the invention will now be described in greater detail.

Figure 5:
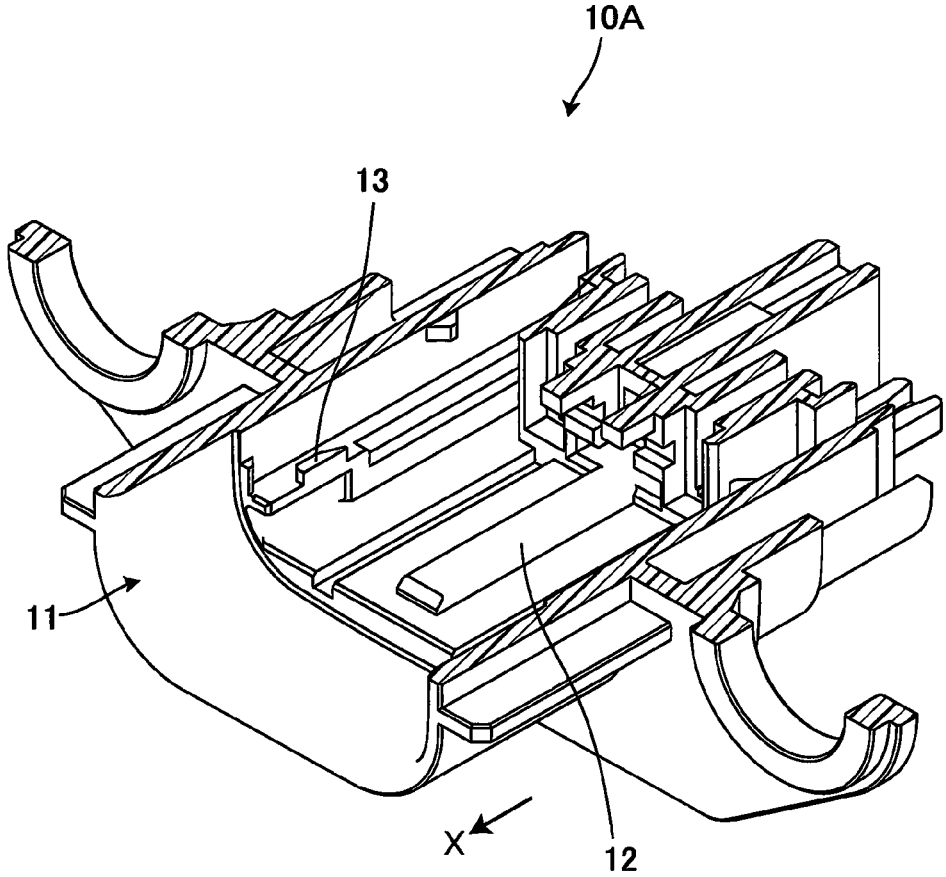
FIG. 5 is a sectional perspective view of a housing of the connector of FIG. 1.

The housing 10 is shown in FIGS. 1-3 and 5-7. The housing 10 has a mating connector receiving passageway 11 opened in a forward direction (a direction of arrow X in FIG. 1). The housing 10 is composed of a combination of a front housing 10A and a rear housing 10B. The housing 10 has a flange 14 disposed between the front housing 10A and the rear housing 10B. The front housing 10A, as shown in FIG. 5, has raised portions 12 extending forward and backward. The raised portions 12 are formed inside the mating connector receiving passageway 11 of the housing 10, one on each of upper and lower sides. The housing 10 also has four housing side locking portions 13 formed inside the mating connector receiving passageway 11 on lateral sides.

Figure 2:
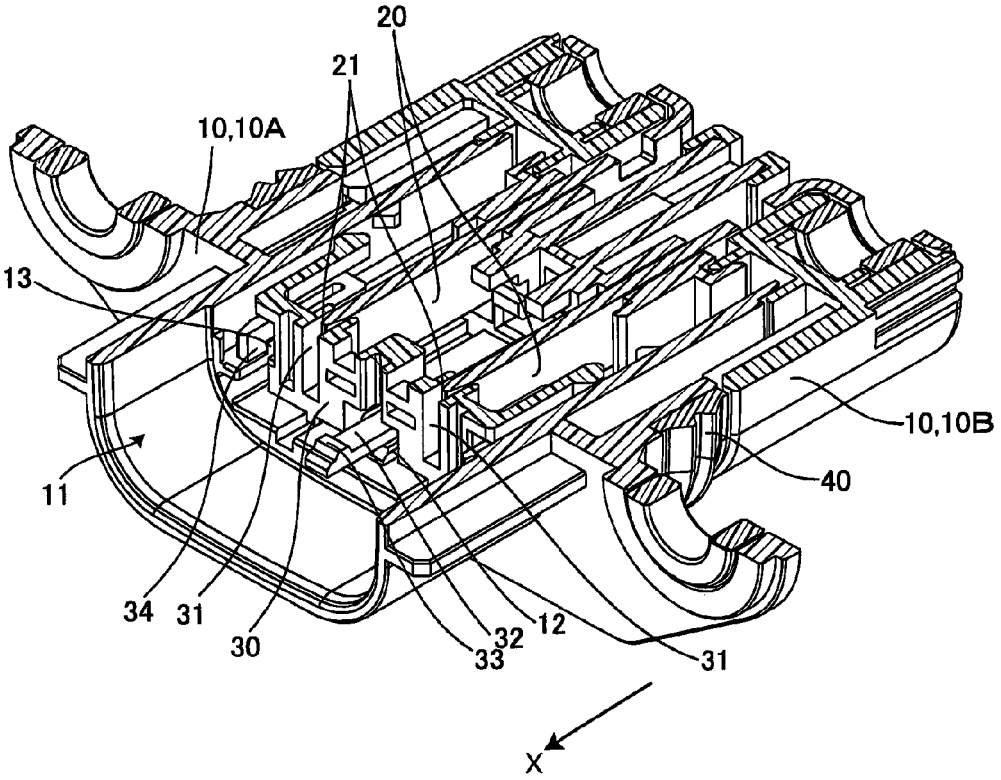
FIG. 2 is a sectional perspective view of the connector of FIG. 1.
Figure 3:
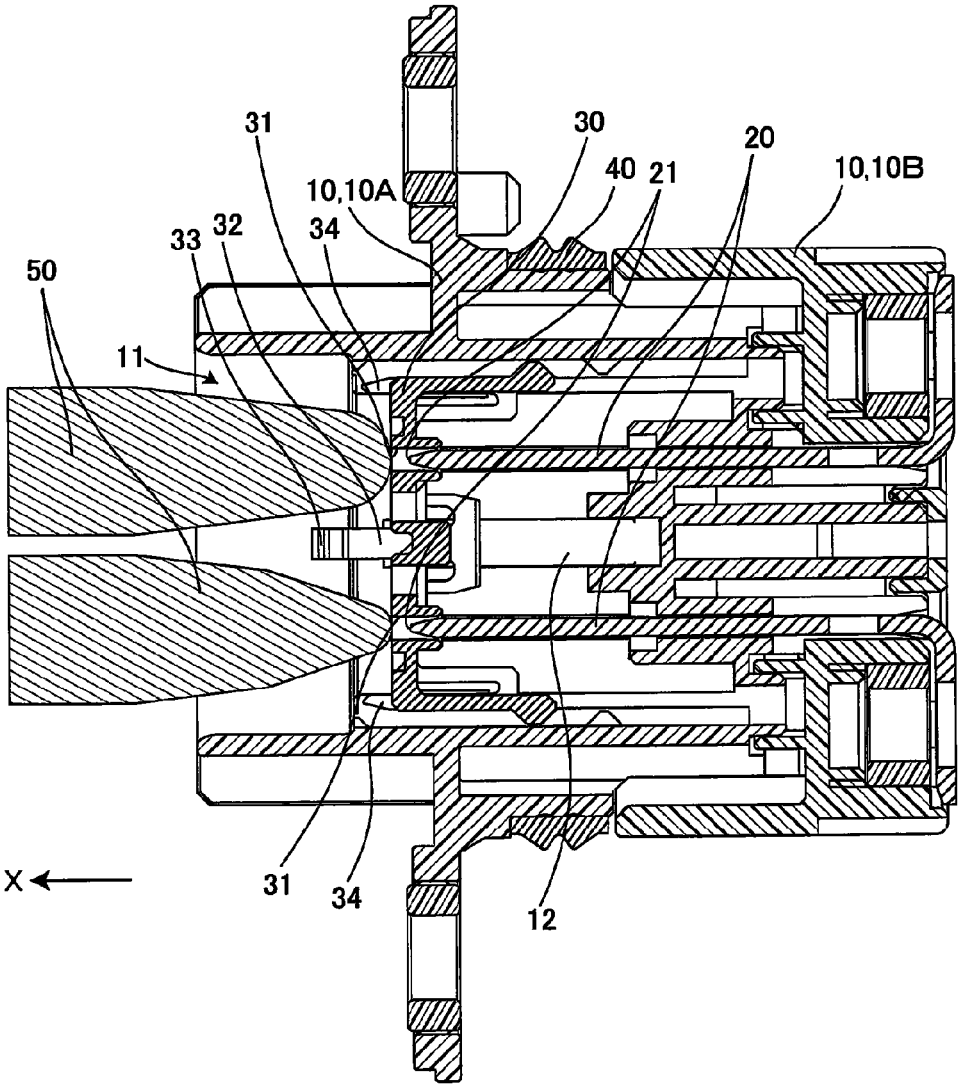
FIG. 3 is sectional plan view of the connector of FIG. 1.

The plurality of terminals 20 are shown in FIGS. 2 and 3. The shown embodiment has two terminals 20, but one with ordinary skill in the art would understand that the number of terminals 20 could vary based on the application. Each of the plurality of terminals 20 has a front end 21.

Figure 4:
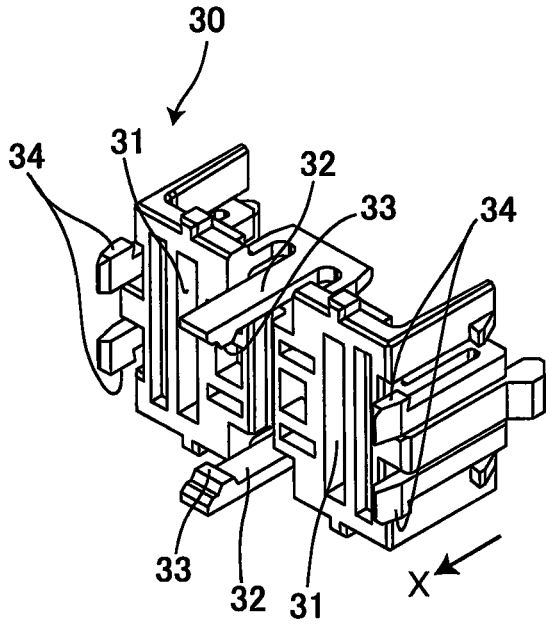
FIG. 4 is a perspective view of a moving plate of the connector of FIG. 1.

The moving plate 30 is shown in FIGS. 2, 3, 4, 6, and 7. As shown in FIG. 4, the moving plate 30 has two insertion holes 31. The moving plate 30 also has two locking arms 32, one on each of upper and lower sides of the moving plate 30. The locking arms 32 extend forward (in the direction of arrow X) and are formed as cantilevers having a free end and a fixed end. In addition, front end portions of the locking arms 32, which are free ends of the locking arm 32 cantilevers, have latches 33. The moving plate 30 also has four moving plate side locking portions 34, two on each of right and left sides.

The seal ring 40 is shown in FIGS. 1-3 and 7. The sealing ring 40 is formed of a flexible material designed to create a waterproof seal.

As shown in FIG. 2, the terminals 20 are press-fitted in the housing 10 and thus supported by the housing 10, but the terminals 20 may be fixed by another means. Further, the terminals 20 extends forward (in the direction of arrow X) into the passageway 11. High voltage (for example, 1200 V) is applied to the terminals 20. Therefore, an electric shock prevention structure is required in order to avoid an electric shock due to contact with the terminal 20.

The moving plate 30 is disposed in the passageway 11, and can freely slide forward (in the direction of arrow X) and backward (in the opposite direction of arrow X) in a reciprocating manner. A position in which the moving plate 30 is slid forward (in the direction of arrow X) to the maximum is referred to as front position. FIGS. 2 and 3 show the moving plate 30 slid to the front position. Further, a position in which the moving plate 30 is slid backward (in the opposite direction of arrow X) to the maximum is referred to as rear position. FIGS. 6(C) and 7(A) described below show the moving plate 30 slid to the rear position. The two terminals 20 are inserted into the two insertion holes 31, respectively. When the moving plate 30 slides to the front position shown in FIGS. 2 and 3, the moving plate side locking portions 34 and the housing side locking portions 13 are locked to each other. Then, this lock firmly blocks the sliding of the moving plate 30 from the front position to the rear position.

The seal ring 40 is positioned to encircle an outer surface of the front housing 10A near the rear housing 10B and behind the flange 14, as shown in FIGS. 1 and 2.

Figure 6:
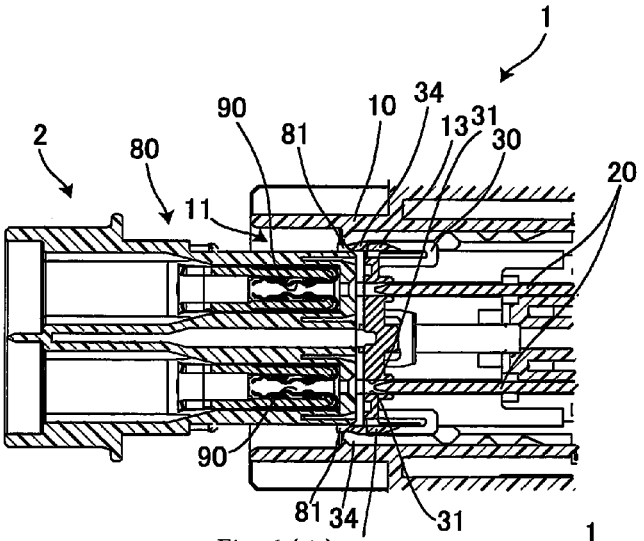
FIG. 6(A) is a sectional side view of the connector and the mating connector in an insertion state before mating.
FIG. 6(B) is a sectional side view of the connector and the mating connector in an insertion state in the process of mating.
FIG. 6(C) is a sectional side view of the connector and the mating connector in an insertion state in which mating is completed.
Figure 6:
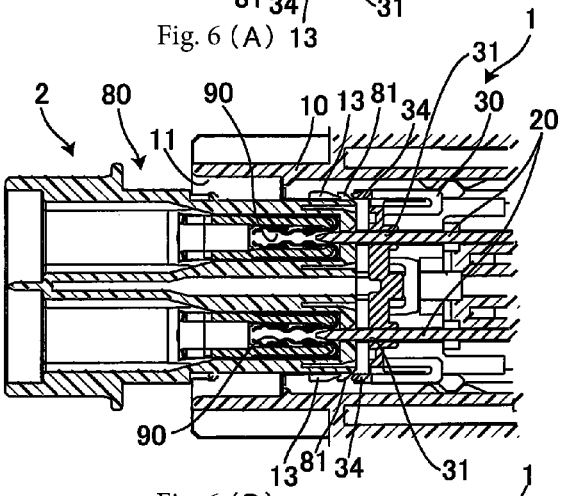
Figure 6:
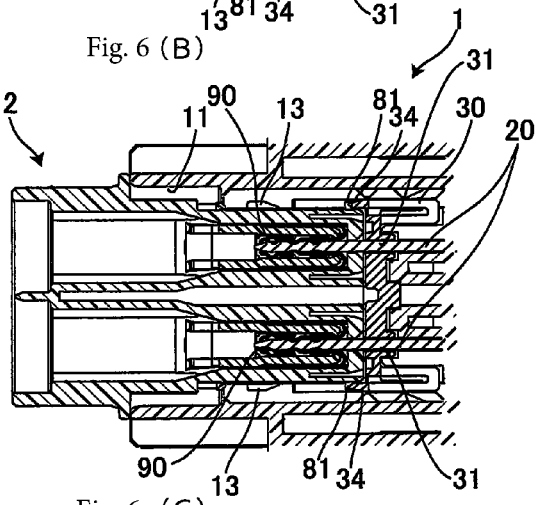
Figure 7:
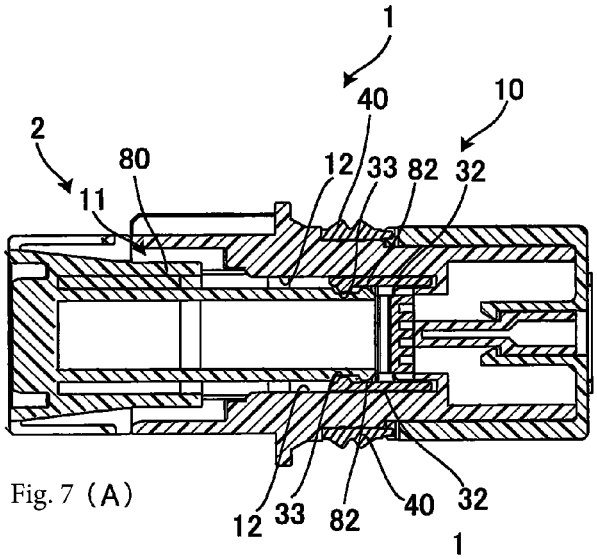
FIG. 7(A) is a sectional side view of the connector and the mating connector in an extraction state in which mating is completed.
FIG. 7(B) is a sectional side view of the connector and the mating connector in an extraction state in which the mating connector is moved in an extracting direction.
FIG. 7(C) is a sectional side view of the connector and the mating connector in an extraction state in which the mating connector is about to be extracted from the connector.
Figure 7:
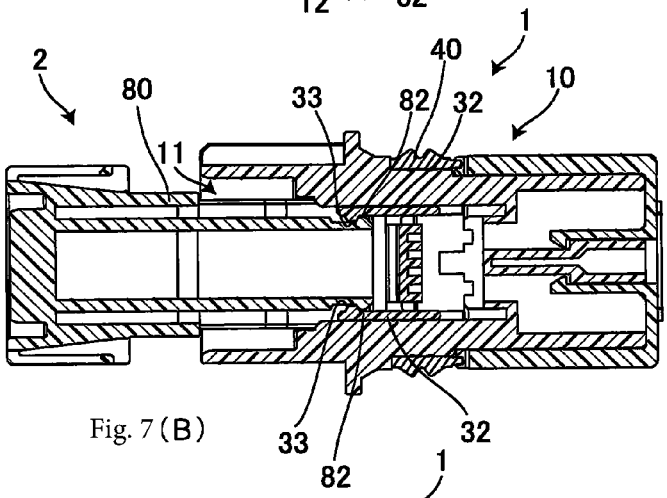
Figure 7:
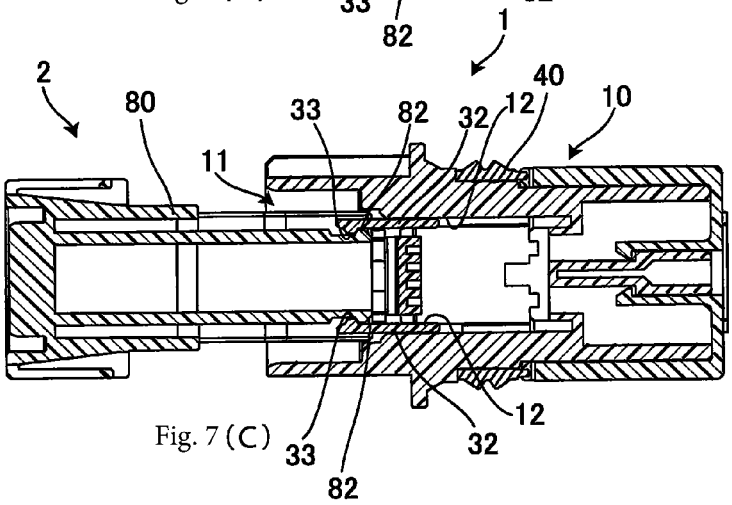

The mating connector 2, as shown in FIGS. 1, 6, and 7, has a mating housing 80 having a plurality of unlocking projections 81 in positions corresponding to the moving plate side locking portions 34 and a plurality of locking projections 82. The mating connector 2 also has a plurality of mating terminals 90 disposed within the mating housing 8

The mating of the connector 1 and mating connector 2, along with the use of the connector 1, will now be described in greater detail.

FIG. 1 shows the connector 1 and the mating connector 2 in positions ready for mating with each other. The mating connector receiving passageway 11 opens toward the mating connector 2. A portion of the mating housing 80 is fitted in the passageway 11. By this fitting, the connector 1 and the mating connector 2 are mated with each other.

When the mating connector 2 is not mated with the connector 1, the moving plate 30 stays at the front position shown in FIGS. 2 and 3. When the moving plate 30 is located at the front position, front ends 21 of the terminals 20 are retracted inside the insertion holes 31 of the moving plate 30. Therefore, even if a finger 50 shown in FIG. 3 enters into the passageway 11 of the housing 10, the finger 50 never touches the terminals 20. Thereby, an electric shock is prevented.

The insertion of the mating connector 2 into the connector 1 will be described with reference to FIGS. 6(A), 6(B), and 6(C). FIGS. 6(A), 6(B) and 6(C) show a state immediately before mating of the connector 1 and the mating connector 2, a state in the process of mating, and a state when the mating is completed, respectively. FIGS. 6(A), 6(B) and 6(C) are sectional plan views showing the connector 1 and the mating connector 2 taken along a horizontal plane crossing the lower two moving plate side locking portions 34 of the four moving plate side locking portions 34 shown in FIG. 4.

As shown in FIG. 6(A), before the mating of the mating connector 2 with the connector 1, the moving plate 30 is located at the front position. When the moving plate 30 is located at the front position, the moving plate side locking portions 34 are locked to the housing side locking portions 13, as shown in FIG. 6(A). Therefore, when the moving plate 30 is pressed by a finger or the like, as shown in FIG. 3, the moving plate 30 does not slide but stays at the front position.

When the mating connector 2 starts to be mated with the connector 1, as shown in FIG. 6(B), the unlocking projections 81 come into contact with the moving plate side locking portions 34 and elastically move the moving plate side locking portions 34. Thereby, the lock of the moving plate side locking portion 34 and the housing side locking portion 13 is released, so that the moving plate 30 can slide from the front position to the rear position. The moving plate 30 slides with the locking arms 32 in contact with the raised portions 12.

When the mating connector 2 is further advanced toward the connector 1, they reach the state of mating completion shown in FIG. 6(C). In this state, the moving plate 30 is slid to the rear position. The rear position is a position in which longitudinal portions of the terminals 20 project forward beyond the insertion holes 31 of the moving plate 30. The terminals 20 mate and electrically connect with the mating terminals 90 in the rear position shown in FIG. 6(C).

The extraction of the mating connector 2 from the connector 1 will now be described with reference to FIGS. 7(A), 7(B), and 7(C). FIGS. 7(A), 7(B) and 7(C) show a state in which the mating connector 2 is completely mated with the connector 1, a state in which the mating connector 2 is slightly moved in an extracting direction, and a state in which the mating connector 2 is about to be extracted from the connector 1, respectively. FIGS. 7(A), 7(B) and 7(C) are sectional side views taken along a vertical plane passing through the upper and lower two locking arms 32 shown in FIG. 4.

In a state shown in FIG. 7(A) in which the mating connector 2 is completely mated with the connector 1, the locking projections 82 are locked with the latches 33 and are located closer to fixed end sides of the locking arms 32 than the latches 33 in order to engage the latches 33. Since the locking arms 32 are in contact with the raised portions 12 of the housing 10, the locking arms 32 cannot deflect outward.

When the mating connector 2 is pulled in the extracting direction from the connector 1, as shown in FIG. 7(B), the locking projections 82 remain locked to the latches 33. The moving plate 30 is thus pulled out toward the front position when the mating connector 2 is pulled out in the extracting direction.

FIG. 7(C) shows the state immediately after the moving plate 30 is pulled out to the front position. When the moving plate 30 is pulled out to the front position shown in FIG. 7(C), the distal end portions of the locking arms 32 on the sides of the latches 33 are moved out of the raised portions 12 disposed in the housing 10. When the locking arms 32 are in this state, the latches 33 can deflect outward. Then, the mating connector 2 in the state shown in FIG. 7(C) is further pulled out in the extracting direction and the locking portions 82 move over the latches 33 in the extracting direction while deflecting the locking arms 32 outward. The mating connector 2 is thereby completely extracted from the connector 1.

Though a final stage of the extraction of the mating connector 2 has been described above with reference to FIG. 7(C), next, an initial stage of the mating of the mating connector 2 will be described with reference to FIG. 7(C). In this regard, FIG. 7(C) and FIG. 6(A) show the same initial stage of the mating of the mating connector 2 with the connector 1. The mating connector 2 advances from a non-mating state to the mating initial stage shown in FIG. 7(C). During that process, the locking projections 82 move over the latches 33 in the mating direction while deflecting the distal end portions of the locking arms 32 of the moving plate 30. At this time, as shown in FIG. 6(A), the moving plate side locking portions 34 remain locked to the housing side locking portions 13. That is, with the moving plate 30 locked at the front position, the locking projections 82 of the mating connector 2 move over the latches 33 in the mating direction. Thereby, the moving plate 30 cannot be pushed by the mating connector 2 and slid toward the rear position without the locking projections 82 moving over the latches 33 in the mating direction.

FIGS. 7(C) and 6(A) show the same final stage of the extraction as well as the same initial stage of the mating. During the extraction of the mating connector 2, when the locking projections 82 are locked to the latches 33, the moving plate side locking portions 34 are locked to the housing side locking portions 13, as shown in FIG. 6(A). That is, until it is ensured that the moving plate 30 has moved to the front position and has become incapable of sliding toward the rear position, the lock of the latches 33 by the locking projections 82 is not released. After the moving plate 30 is locked at the front position and becomes incapable of sliding, the lock of the locking projection 82 and the latches 33 is released, and then the mating connector 2 is completely extracted from the connector 1.

Consequently, the locking projections 82 reliably move over the latches 33 in the mating direction during the mating of the mating connector 2 with the connector 1. Then, when the moving plate 30 starts sliding from the front position toward the rear position, the deflection of the locking arms 32 is blocked by the raised portions 12. For this reason, during the extraction of the mating connector 2, the lock of the locking projections 82 and the latches 33 ensures that the moving plate 30 slides to the front position and is locked at the front position. Therefore, according to the present embodiment, a highly reliable electric shock prevention structure is achieved.

What is claimed is:

1. A connector, comprising:

a housing having a mating connector receiving passageway and a raised portion formed inside the mating connector receiving passageway;

a terminal disposed in the housing and extending into the mating connector receiving passageway; and a moving plate having a locking arm and an insertion hole into which the terminal is inserted, the moving plate disposed in the mating connector receiving passageway and movable between a front position in which a front end of the terminal is retracted inside the insertion hole and a rear position in which the terminal extends beyond the insertion hole, the raised portion abutting the locking arm and preventing deflection of the locking arm when the moving plate is located out of the front position, the locking arm is a cantilever having a latch on a free end, the latch locked to a mating connector when the mating connector is inserted in the mating connector receiving passageway.

2. The connector of claim 1, wherein a portion of the terminal extending beyond the insertion hole in the rear position is electrically connected to a mating terminal of the mating connector.

3. The connector of claim 1, wherein extraction of the mating connector from the mating connector receiving passageway moves the moving plate to the front position.

4. The connector of claim 1, wherein, when the moving plate is in the front position, insertion of the mating connector into the mating connector receiving passageway deflects the locking arm.

5. The connector of claim 4, wherein the housing has a housing side locking portion formed inside the mating connector receiving passageway.

6. The connector of claim 5, wherein the moving plate has a moving plate side locking portion disposed on a side of the moving plate.

7. The connector of claim 6, wherein, when the moving plate is in the front position, the moving plate side locking portion is locked to the housing side locking portion and prevents movement of the moving plate toward the rear position.

8. The connector of claim 7, wherein the moving plate side locking portion is released from the housing side locking portion when the mating connector is inserted into the mating connector receiving passageway.

9. The connector of claim 8, wherein, when the moving plate is in the front position and the mating connector is inserted into the mating connector receiving passageway, the locking arm is deflected by the mating connector before the moving plate side locking portion is released from the housing side locking portion.

10. The connector of claim 1, further comprising a seal ring disposed around an outer surface of the housing.

11. A connector, comprising:

a housing having a mating connector receiving passageway, a raised portion formed inside the mating connector receiving passageway, and a housing side locking portion formed inside the mating connector receiving passageway;

a terminal disposed in the housing and extending into the mating connector receiving passageway; and a moving plate having a locking arm, an insertion hole into which the terminal is inserted, and a moving plate side locking portion disposed on a side of the moving plate, the moving plate disposed in the mating connector receiving passageway and movable between a front position in which a front end of the terminal is retracted inside the insertion hole and a rear position in which the terminal extends beyond the insertion hole, the raised portion abutting the locking arm and preventing deflection of the locking arm when the moving plate is located out of the front position, the moving plate side locking portion is locked to the housing side locking portion when the moving plate is in the front position and prevents movement of the moving plate toward the rear position, and the moving plate side locking portion is released from the housing side locking portion when a mating connector is inserted into the mating connector receiving passageway.

12. The connector of claim 11, wherein, when the moving plate is in the front position and the mating connector is inserted into the mating connector receiving passageway, the locking arm is deflected by the mating connector before the moving plate side locking portion is released from the housing side locking portion.

13. The connector of claim 11, wherein a portion of the terminal extending beyond the insertion hole in the rear position is electrically connected to a mating terminal of the mating connector.

14. The connector of claim 11, wherein extraction of the mating connector from the mating connector receiving passageway moves the moving plate to the front position.

15. The connector of claim 11, wherein, when the moving plate is in the front position, insertion of the mating connector into the mating connector receiving passageway deflects the locking arm.

16. The connector of claim 11, further comprising a seal ring disposed around an outer surface of the housing.

* * * * *